US008325000B2

(12) United States Patent
Oki et al.

(10) Patent No.: US 8,325,000 B2
(45) Date of Patent: Dec. 4, 2012

(54) MAGNETIC COMPONENT

(75) Inventors: Juichi Oki, Tokyo (JP); Yoshiyuki Hatayama, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/677,415

(22) PCT Filed: Aug. 29, 2008

(86) PCT No.: PCT/JP2008/065591

§ 371 (c)(1),
(2), (4) Date: Mar. 10, 2010

(87) PCT Pub. No.: WO2009/034860

PCT Pub. Date: Mar. 19, 2009

(65) Prior Publication Data

US 2011/0006867 A1 Jan. 13, 2011

(30) Foreign Application Priority Data

Sep. 10, 2007 (JP) ..... 2007-233547

(51) Int. Cl.
*H01F 27/29* (2006.01)
*H01F 27/02* (2006.01)
*H01F 17/04* (2006.01)

(52) U.S. Cl. ..... 336/192; 336/83; 336/90; 336/98; 336/221

(58) Field of Classification Search ..... 336/83, 336/90, 98, 192, 221
See application file for complete search history.

(56) References Cited

U.S. PATENT DOCUMENTS

| | | | | |
|---|---|---|---|---|
| 6,249,202 | B1 * | 6/2001 | Yamada | 336/65 |
| 7,142,082 | B2 | 11/2006 | Kakehashi et al. | |
| 2003/0071704 | A1 * | 4/2003 | Toi et al. | 336/83 |
| 2003/0179062 | A1 * | 9/2003 | Kuwata et al. | 336/83 |
| 2005/0017835 | A1 * | 1/2005 | Oki | 336/65 |
| 2005/0104698 | A1 | 5/2005 | Kakehashi et al. | |
| 2006/0267719 | A1 * | 11/2006 | Yasuda et al. | 336/223 |
| 2007/0132535 | A1 | 6/2007 | Kakehashi et al. | |
| 2007/0146110 | A1 * | 6/2007 | Oki | 336/232 |
| 2007/0159282 | A1 * | 7/2007 | Huang et al. | 336/83 |

FOREIGN PATENT DOCUMENTS

| | | | |
|---|---|---|---|
| CN | 1393020 | A | 1/2003 |
| EP | 1324357 | A1 | 7/2003 |
| JP | 6-7210 | U | 1/1994 |
| JP | 6-36961 | A | 2/1994 |
| JP | 6-163300 | A | 6/1994 |

(Continued)

OTHER PUBLICATIONS

International Search Report for PCT/JP2008/065591 mailed Dec. 2, 2008 with English translation.
Chinese Office Action for Chinese Patent Application No. 200880105725.X mailing date of Apr. 27, 2011.
Decision of Final Rejection of Japanese Patent Application No. 2009-532138, dated Feb. 14, 2012, with English translation.

(Continued)

*Primary Examiner* — Mohamad Musleh
*Assistant Examiner* — Tsz Chan
(74) *Attorney, Agent, or Firm* — Cantor Colburn LLP

(57) ABSTRACT

A magnetic component may include a core including an upper collar, a lower collar, and a spool portion around which a lead wire is wound and external terminals which are directly disposed on the lower collar and to which both ends of the lead wire are connected. The external terminals may include a terminal end fixing portion. The terminal ends of the lead wire may be positioned by the terminal end fixing portions, and may be connected to the external terminals.

12 Claims, 8 Drawing Sheets

FOREIGN PATENT DOCUMENTS

| | | | | |
|---|---|---|---|---|
| JP | 2006-73848 | A | | 3/2006 |
| JP | 2006210827 | A | * | 8/2006 |
| JP | 2006-310487 | A | | 11/2006 |
| JP | 2007-258201 | A | | 10/2007 |
| WO | 02/23561 | A1 | | 3/2002 |

OTHER PUBLICATIONS

Office Action of Japanese Patent Application No. 2009-532138, mailed Oct. 25, 2011, with English translation.

* cited by examiner

MAGNETIC COMPONENT

CROSS REFERENCE

This is a U.S. national stage application of International Application No. PCT/JP2008/065591, filed on 29 Aug. 2008. Priority under 35 U.S.C. §119(a) and 35 U.S.C. §365(b) is claimed from Japanese Application No. JP2007-233547, filed 10 Sep. 2007, the disclosure of which is also incorporated herein by reference.

TECHNICAL FIELD

The present invention relates to a magnetic component.

BACKGROUND ART

Many magnetic components are composed by being subjected to a process of binding both ends of a lead wire such as an enamel wire wound around a core to terminals once to three times and connecting such bound portions to the terminals by soldering. This process of binding both ends of the lead wire to the terminals is complicated, and accordingly, a technology for welding the lead wire to the terminals while omitting such binding work has been proposed (refer to Patent Document 1). Further, besides the welding described above, there is also a case of solder-connecting the lead wire while omitting the binding work.

Patent Document 1: JP 06-36961 A

DISCLOSURE OF THE INVENTION

Problem to be Solved by the Invention

However, in the case of omitting the binding work as described above, connection is only performed between surfaces of both ends and the terminals by the welding, or alternatively, connection is only performed between the surfaces of both ends and the terminals by the soldering. Accordingly, this leads to lack of reliability and stability of the connection. Hence, the connection between the lead wire and the terminals is sometimes released before the magnetic component is surface-mounted.

Therefore, it is an purpose of the present invention to make it possible to provide a magnetic component, which is capable of omitting the process of binding both ends of the lead wire to the terminals, and in which the connection between the lead wire and the terminals is stable.

Means for Solving the Problem

In order to solve the above-mentioned problem, a magnetic component of the present invention includes: a core including a spool portion around which a lead wire is wound; and external terminals to which both ends of the lead wire are connected, in which the external terminals respectively include a terminal end fixing portion capable of receiving movement of terminal ends of the lead wire in an unwinding direction, and in which the terminal ends of the lead wire are positioned by the terminal end fixing portions, and are connected to the external terminals.

In the magnetic component of the present invention, the terminal end fixing portions which receive the movement of the terminal ends of the lead wire in the unwinding direction are provided. Accordingly, by the terminal end fixing portions, the terminal ends of the lead wire are connected to the external terminals in a state of being positioned at predetermined positions so as not to move. Hence, electrical connection between the lead wire and the external terminals is stable.

Therefore, the process of binding the both ends of the lead wire to the terminals may also be omitted.

Further, in another magnetic component according to the present invention, in addition to the above-mentioned invention, a height L1 of each of the terminal end fixing portions is larger than a height L2 of a cross section of each of the terminal ends of the lead wire. By adopting this configuration, the connection between the terminal ends of the lead wire and the external terminals may be maintained even if the terminal ends of the lead wire somewhat moves in a direction different from the unwinding direction. Accordingly, the electrical connection between the lead wire and the external terminals may be stably maintained.

Further, in another magnetic component according to the present invention, in addition to the above-mentioned invention, the both ends of the lead wire protrude from the core toward the same direction. By adopting this configuration, a process of connecting the lead wire and the external terminals to each other by using soldering or welding may be easily performed.

Further, in another magnetic component according to the present invention, in addition to the above-mentioned invention, each of the external terminals includes: a mounting board connecting portion; a plate-like protruding portion that hangs out of an outer circumference of the core and has a plate surface substantially parallel to a plane substantially orthogonal to an axial direction of the core; and the plate-like terminal end fixing portion provided so as to be erected from the protruding portion at a predetermined angle and to form a projection portion. By adopting this configuration, the external terminal and the terminal end of the lead wire are connected to each other on the outer circumference side of the core, and accordingly, connection work therebetween is easy. Further, the lead wire is brought into contact with both of the terminal end fixing portion provided so as to be erected from the protruding portion of each of the external terminals at the predetermined angle and to form the projection portion and the protruding portion, whereby a contact area between the lead wire and each of the external terminals may be increased, and connection strength therebetween may be enhanced.

Further, in another magnetic component according to the present invention, in addition to the above-mentioned invention, the angle formed by the protruding portion and the terminal end fixing portion ranges from 30° to 80°. By adopting this configuration, slippage on a contact portion between the terminal end of the lead wire and each of the external terminals is less likely to occur even if force to move the terminal end of the lead wire in the unwinding direction acts thereon. Therefore, the electrical connection between the lead wire and each of the external terminals may be further stabilized.

Further, in another magnetic component according to the present invention, in addition to the above-mentioned invention, the angle formed by the protruding portion and the terminal end fixing portion ranges from 60° to 70°. By adopting this configuration, the slippage on the contact portion between the terminal end of the lead wire and each of the external terminals is less likely to occur even if force to move the terminal end of the lead wire in the unwinding direction acts thereon. In addition, force that the terminal end of the lead wire moves in the unwinding direction may be received by the terminal end fixing portion more surely, and accordingly, the terminal end of the lead wire is fixed to each of the external terminals more surely. Therefore, the electrical connection between the lead wire and each of the external terminals may be further stabilized.

Further, in another magnetic component according to the present invention, in addition to the above-mentioned invention, a tip end portion of the terminal end fixing portion is bent to the protruding portion side. By adopting this configuration, the terminal end of the lead wire is located between the tip end portion of the terminal end fixing portion and the protruding portion. Therefore, it becomes more difficult for the terminal end of the lead wire to move in a direction other than the unwinding direction. Hence, the electrical connection between the lead wire and each of the external terminals may be extremely stabilized.

Further, in another magnetic component according to the present invention, in addition to the above-mentioned invention, the protruding portion including the terminal end fixing portion is individually provided on each end portion of the mounting board connecting portion. By adopting this configuration, both terminal ends of the lead wire wound around the spool portion may be protruded in directions substantially opposite to each other.

Further, in another magnetic component according to the present invention, in addition to the above-mentioned invention, a height dimension from a joint of the terminal end fixing portion to a top thereof in each of the external terminals is set larger than a height dimension of the both ends of the lead wire. By adopting this configuration, the tip end of the lead wire may be suppressed from moving in a direction opposite to a winding direction thereof more surely.

Further, in another magnetic component according to the present invention, in addition to the above-mentioned invention, the core includes a drum core, and further, a ring core is arranged on an outer circumference of the drum core. By adopting this configuration, leakage of a magnetic flux generated from the lead wire is suppressed, and an AL value (inductance value per unit number of turns of the lead wire) may be enhanced.

Further, in another magnetic component according to the present invention, in addition to the above-mentioned invention, the terminal ends of the lead wire and the external terminals are connected to each other by any one of connection methods selected from soldering and welding. By adopting this configuration, the terminal ends of the lead wire are surely fixed to predetermined positions of the external terminals, and accordingly, the electrical connection between the lead wire and the external terminals may be extremely stabilized. In particular, in the case of performing the soldering for the portions in which the terminal ends of the lead wire and the external terminals are connected to each other in the contact state, the tip end of the lead wire may be suppressed from moving in the direction opposite to the winding direction thereof in the event of a reflow and the like, and the electrical connection in a state where the magnetic component is mounted may be more stabilized.

Further, in another magnetic component according to the present invention, in addition to the above-mentioned invention, a surface of each of the terminal end fixing portions is provided at a position perpendicular with respect to the unwinding direction. By adopting this configuration, force that acts on each terminal end of the lead wire in the unwinding direction may be surely received on the surface of each of the terminal end fixing portions. Therefore, each terminal end of the lead wire may be suppressed from sliding on the surface of each of the terminal end fixing portions in a height direction of each of the terminal end fixing portions. Hence, the electrical connection between the lead wire and the external terminals may be extremely stabilized.

Effects of the Invention

As described above, in the present invention, it becomes possible to provide a magnetic component, which is capable of omitting the process of binding both ends of the lead wire to the terminals, and in which the connection between the lead wire and the terminals is stable.

DESCRIPTION OF SYMBOLS

1 magnetic component
2 core
3 lead wire
3A, 3B tip end portion (both ends of lead wire)
4, 5 external terminal
4C, 5C projection portion
8 solder

BEST MODE FOR CARRYING OUT THE INVENTION

Hereinafter, a description is made of embodiments of the present invention based on the drawings.

(Configuration of Magnetic Component)

Figure 1A:
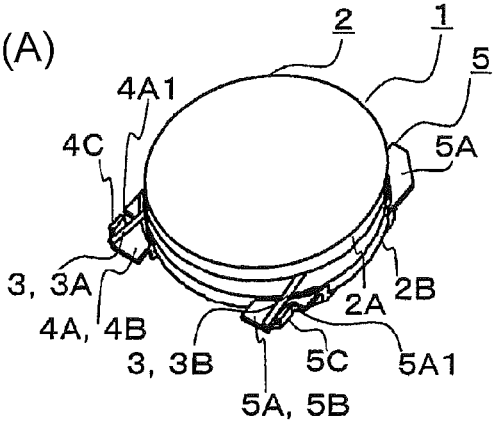
FIG. 1(A) is a perspective view illustrating a flat surface (surface opposite with a side facing to a mounting board) of a magnetic component according to an embodiment of the present invention, a front surface (surface on a side on which tip ends of a lead wire protrude) thereof and a right side surface thereof.
Figure 1B:
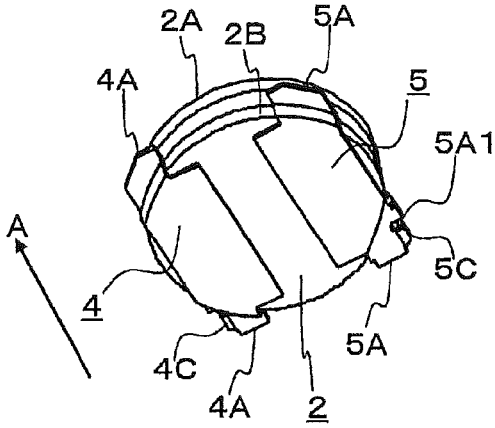
FIG. 1(B) is a perspective view illustrating a bottom surface (surface on the side facing to the mounting board) of the magnetic component according to the embodiment of the present invention, aback surface thereof, and a right side surface thereof.
Figure 2:
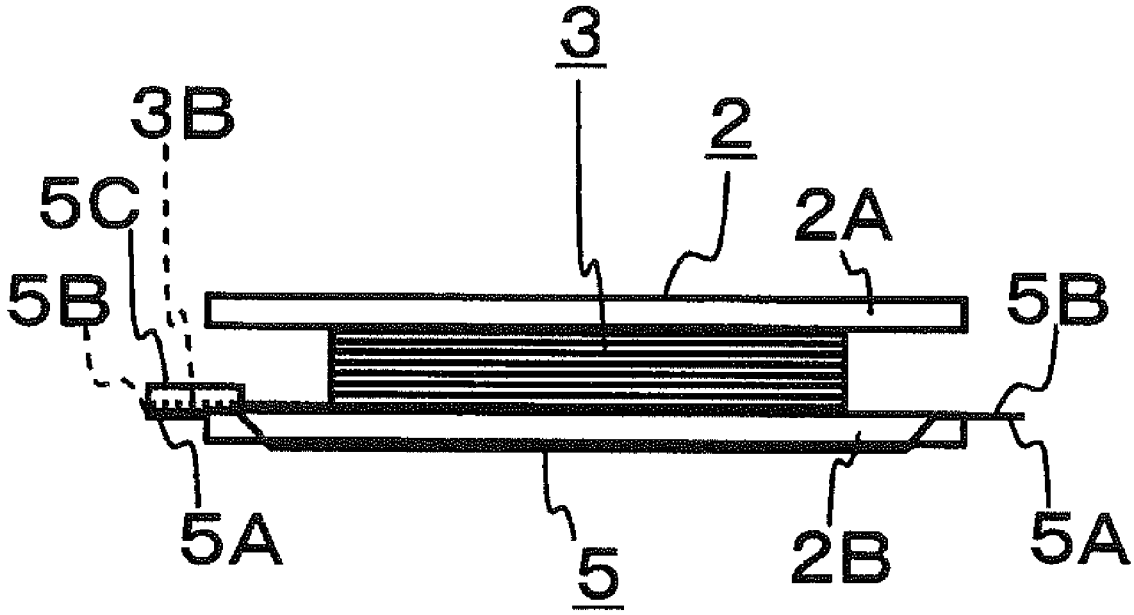
FIG. 2 is a right side view of the magnetic component illustrated in FIG. 1.

FIG. 1(A) is a perspective view illustrating a flat surface (surface opposite with a side facing to a mounting board) of a magnetic component 1 for surface mounting according to an embodiment of the present invention, a front surface (surface on a side on which tip ends of a lead wire protrude) thereof, and a right side surface thereof. FIG. 1(B) is a perspective view illustrating a bottom surface (surface on the side facing to the mounting board) of the magnetic component 1 according to the embodiment of the present invention, aback surface thereof, and a right side surface thereof. FIG. 2 is a right side view of the magnetic component 1 illustrated in FIG. 1.

A core 2 is formed of a magnetic material such as Mn—Zn based ferrite and Ni—Zn based ferrite. Moreover, the core 2 includes an upper collar portion 2A and a lower collar portion 2B, each having a disc shape. An exterior appearance of the core 2 is formed into a drum shape.

A metal portion of a lead wire 3 is made of a conductive linear material such as copper. Further, a side surface of the lead wire 3, which excludes tip end portions 3A and 3B which are both ends of the lead wire 3, is coated in an insulating manner. Further, a cross section of the lead wire 3 is circular. The lead wire 3 is wound a large number of times in a winding manner of so-called α-winding along a spool portion of the core 2, which excludes the upper collar portion 2A and the lower collar portion 2B. Hence, protruding directions of the tip end portions 3A and 3B of the lead wire 3 are different from each other. The tip end portion 3A protrudes so as to be directed counterclockwise when viewed from the drawing of FIG. 1(A) (when viewed from the flat surface of the magnetic component 1), and the tip end portion 3B protrudes so as to be directed clockwise when viewed from the drawing of FIG. 1(A). The tip end portions 3A and 3B of the lead wire 3 protrude from the core 2 in substantially parallel to each other, that is, in the same direction. The lead wire 3 wound a large number of times around a circumferential surface of the core 2 attempts to loosen in a direction opposite to a winding direction owing to spring property thereof. However, the lead wire 3 wound a large number of times is fixed, for example, by coating adhesive on the spool portion and so on so as to maintain a wound state of the lead wire 3 concerned.

On the bottom surface of the magnetic component 1, two external terminals 4 and 5 having a predetermined plate shape are arranged in parallel to each other at a fixed interval so as to prevent a short circuit therebetween. The adhesive is used for arranging and fixing the external terminals 4 and 5. Plate-like protruding portions 4A and 5A, which are end portions of the external terminals 4 and 5 and protrude from the core 2, are first bent at end positions of the bottom surface (surface of the lower collar portion 2B on an opposite side with a surface on a side on which the lead wire 3 exists) of the core 2 toward a direction of wrapping the core 2. Then, at positions of the protruding portions 4A and 5A, which are closer to tip ends thereof than the bent positions, the end portions of the external terminals 4 and 5 are bent toward a direction (direction separating from a center of the lower collar portion 2B along a diameter direction) reverse to the direction of wrapping the core 2 so that flat tip end surfaces 4B and 5B on the tip ends of the protruding portions 4A and 5A may be located on substantially the same plane as the other surface (surface on the side on which the lead wire 3 exists) of the lower collar portion 2B. In other words, the protruding portions 4A and 5A are provided so that flat surfaces of the tip end portions thereof may become substantially orthogonal to an axial direction of the core 2.

Further, on one-side ends of the tip end surfaces 4B and 5B on a front side, which are illustrated in FIG. 1(A), notched portions 4A1 and 5A1 are respectively formed on end portions thereof on opposite sides with two end portions in which the tip end surfaces 4B and 5B face to each other. On regions from those notched portions 4A1 and 5A1 to end surfaces located on the tip ends of the protruding portions 4A and 5A, plate-like projection portions (terminal end fixing portions) 4C and 5C are provided as described later. Specifically, portions of the tip end surfaces 4B and 5B, which are more apart from the core 2 than the notched portions 4A1 and 5A1, are extended substantially vertically from the tip end surfaces 4B and 5B in a direction of the upper collar portion 2A, and are bent along an arrow A direction illustrated in FIG. 1(B) as a broken line. Such bent portions become projection portions 4C and 5C. To the tip end surface 4B as one of the tip end surfaces having such one-side ends, the tip end portion 3A of the lead wire 3 is fixed, and to the other tip end surface 5B, the tip end portion 3B of the lead wire 3 is fixed. In order to fix the tip end portions 3A and 3B to the tip end surfaces 4B and 5B more surely, for example, it is preferable to use soldering and welding. Further, on the protruding portions 4A and 5A which exist on the other-side ends (end portions in a direction of a vector of an arrow A of FIG. 1(B)) in a longitudinal direction of the respective external terminals 4 and 5, the notched portions 4A1 and 5A1 and the projection portions 4C and 5C are not formed, and the lead wire 3 is not fixed thereto, either.

With regard to the lead wire 3, the tip end portion 3A is mounted on the tip end surface 4B, and the tip end portion 3B is mounted on the tip end surface 5B. Note that, even in a state where the lead wire 3 is fixed by the adhesive, drawn-out portions (tip end portions 3A and 3B) of the lead wire 3 have the spring property in an expanding direction (unwinding direction) by the fact that the lead wire 3 is wound. Accordingly, when the tip end portions 3A and 3B are mounted on the tip end surfaces 4B and 5B, respectively, the tip end portions 3A and 3B are thrust against the projection portions 4C and 5C, respectively. Such thrust receiving portions of the projection portions 4C and 5C face to each other.

Figure 3:
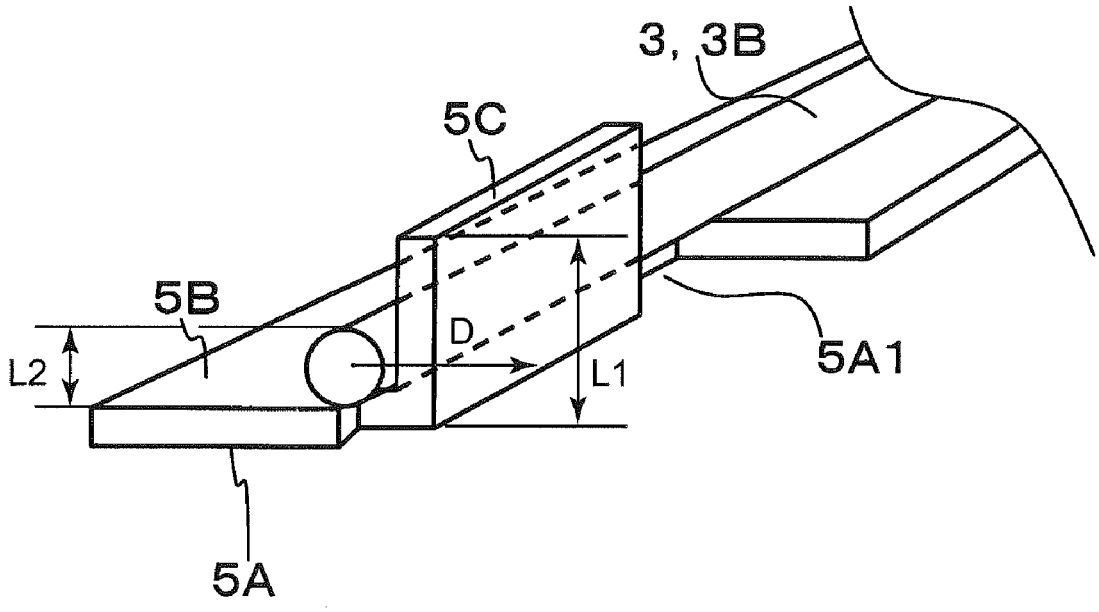
FIG. 3 is a partially enlarged view of FIG. 1(A), and is a view illustrating an example of a state where a tip end portion of the lead wire is mounted on a tip end surface of a protruding portion in which a notched portion and a projection portion (terminal end fixing portion) are formed.

FIG. 3 is a partially enlarged view of FIG. 1(A), and is a view illustrating a state where the tip end portion 3B of the lead wire 3 is mounted on the tip end surface 5B of the protruding portion 5A in which the notched portion 5A1 and the projection portion 5C are formed.

As described above, the tip end portion 3A of the lead wire 3 is arranged so as to be brought into contact with the tip end surface 4B and the projection portion 4C. Further, the tip end portion 3B of the lead wire 3 is arranged so as to be brought into contact with the tip end surface 5B and the projection portion 5C. Here, the projection portions 4C and 5C receive movement of the tip end portions 3A and 3B which go toward the direction where the drawn-out portions (tip end portions 3A and 3B) of the lead wire 3 expand (unwind). Note that a top of the projection portion 4C is located at a higher position than tops of the tip end portions 3A and 3B. However, a cross-sectional shape of the lead wire 3 is circular, and accordingly, the top of the projection portions 4C and 5C just needs to be set at a height dimension more than a radius of the tip end portions 3A and 3B. Further, a height L1 of the projection portion 5C that functions as the terminal end fixing portion is larger than a height L2 of the cross section of the tip end portion 3B of the lead wire 3. Therefore, even if the tip end portion 3B of the lead wire 3 somewhat moves in a direction different from an unwinding direction D, connection between the tip end portion 3B of the lead wire 3 and the external terminal 5 may be maintained, and hence electrical connection between the lead wire 3 and the external terminal 5 may be stably maintained. In addition, the surface (surface in contact with the lead wire 3) of the projection portion 5C that functions as the terminal end fixing portion is provided at the position perpendicular to the unwinding direction D. Accordingly, force that acts on the tip end portion 3B of the lead wire 3 in the unwinding direction D may be surely received on the surface of the projection portion 5C that functions as the terminal end fixing portion. Therefore, the tip end portion 3B of the lead wire 3 may be suppressed from sliding on the surface of the projection portion 5C in a height direction of the projection portion 5C. Hence, the electrical connection between the lead wire 3 and the external terminal 5 may be extremely stabilized.

(Manufacturing Method for Magnetic Component)

The magnetic component 1 configured as described above is manufactured in the following manner.

First, the lead wire 3 is subjected to the so-called α-winding along the spool portion of the core 2 sandwiched between the upper collar portion 2A and the lower collar portion 2B. Then, in order to fix such a portion around which the lead wire 3 is wound, the adhesive is coated on the spool portion, and the lead wire 3 is fixed to the spool portion by curing of the adhesive concerned.

Then, the two external terminals 4 and 5 subjected to a bending process in advance into the above-mentioned predetermined shape (shape having the notched portions 4A1 and 5A1, the bent portions of the protruding portions 4A and 5A, the tip end surfaces 4B and 5B, and the projection portions 4C and 5C) are arranged on a lower surface side of the lower collar portion 2B in a state of being parallel to each other, and the adhesive is interposed between the lower collar portion 2B and the external terminals 4 and 5, whereby both of them are fixed to each other by the adhesive (FIGS. 1 and FIG. 2). After that, the tip end portions 3A and 3B of the lead wire 3 are positioned so as not to move in the direction where the drawn-out portions (tip end portions 3A and 3B) of the lead wire 3 expand (unwind) by the projection portions 4C and 5C. Specifically, the tip end portions 3A and 3B are arranged so that the tip end portions 3A and 3B are brought into contact with the tip end surfaces 4B and 5B and the projection portions 4C and 5C, respectively. Then, the tip end surfaces 4B and 5B are adapted to be located on substantially the same plane as the surface of the lower collar portion 2B on the side where the lead wire 3 exists. In such a way, the tip end portions 3A and 3B of the lead wire are connected to the external terminals 4 and 5. By being subjected to the process described above, the magnetic component 1 according to this embodiment is manufactured.

Note that, in order to more ensure the connection between the tip end portions 3A and 3B of the lead wire and the external terminals 4 and 5, the soldering or the welding may be further used. For example, in the case of using the soldering, the tip end portion 3A, the tip end surface 4B, and the projection portion 4C, and in a similar way, the tip end portion 3B, the tip end surface 5B, and the projection portion 5C are simultaneously brought into contact with molten solder in a soldering pot. Then, enamel portions of the lead wire 3 (tip end portions 3A and 3B) are molten, and the tip end portions 3A and 3B, the tip end surfaces 4B and 5B, and the projection portions 4C and 5C are soldered to one another in a state of electrically conducting to one another.

(Principal Effects of This Embodiment)

As described above, in this embodiment, the external terminals 4 and 5 and the lead wire 3 are connected to each other. The projection portions 4C and 5C exist on the external terminals 4 and 5, whereby it becomes possible to receive the drawn-out portions (tip end portions 3A and 3B) of the lead wire 3 by the projection portions 4C and 5C even if the drawn-out portions have the sprig property directed to the expanding direction (unwinding direction). In such a way, the electrical connection between the tip end portions 3A and 3B and the external terminals 4 and 5 may be stabilized. Further, in this embodiment, the magnetic component is not subjected to a complicated process of binding both ends of the lead wire to the terminals, and accordingly, the magnetic component may be manufactured easily.

Further, in this embodiment, the tops of the projection portions 4C and 5C are arranged at the positions higher than the tops of both ends of the lead wire 3, and accordingly, the drawn-out portions (tip end portions 3A and 3B) of the lead wire 3 may be surely suppressed from moving toward the expanding direction (unwinding direction).

Further, in this embodiment, the tip end portions 3A and 3B of the lead wire 3 protrude from the core 2 in the same direction. Accordingly, in the case of using the soldering or the welding in order to further stabilize the connection, the tip end portions 3A and 3B and the external terminals 4 and 5 may be simultaneously connected to each other by the soldering or the welding, and therefore the manufacturing process may be easily performed.

Figure 4A:
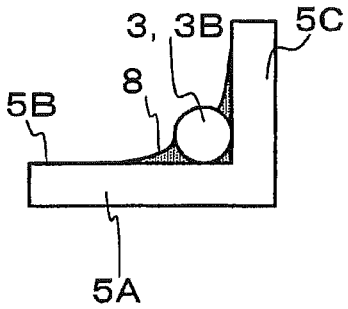
FIG. 4(A) is a partially enlarged view of a front view of the magnetic component according to this embodiment, which is illustrated in FIG. 1(A), and is a view illustrating a state where a tip end surface and a projection portion (terminal end fixing portion) of an external terminal and the lead wire are connected to each other by solder.
Figure 4B:
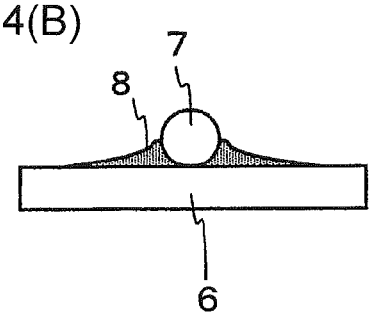
FIG. 4(B) is a view of a conventional magnetic component, which corresponds to FIG. 4(A), and is a view illustrating a state where a conventional external terminal, which do not allow the projection portion (terminal end fixing portion) to exist thereon, and a conventional lead wire are connected to each other by the solder.

Further, in this embodiment, the tip end surfaces 4B and 5B and the projection portions 4C and 5C exist. Accordingly, in the case of using the soldering in order to further stabilize the connection, merits which are described below are obtained. Specifically, a solder joint area of the lead wire 3 and the external terminals 4 and 5 is increased, and accordingly, connection strength between both of the lead wire 3 and the external terminals 4 and 5 may be further enhanced. FIG. 4(A) is a partially enlarged view of a front view of the magnetic component 1 according to this embodiment, which is illustrated in FIG. 1(A), and is a view illustrating a state where the tip end surface 5B and projection portion 5C of the external terminal 5 and the lead wire 3 are connected to each other by solder 8. Further, FIG. 4(B) is a view illustrating a portion of a conventional magnetic component, which corresponds to FIG. 4(A), and is a view illustrating a state where a conventional external terminal 6, which do not allow the projection portions 4C and 5C to exist thereon, and a lead wire 7 are connected to each other by the solder 8. FIG. 4(B) illustrates a state where a lower portion of the lead wire 7 is mainly supported on the external terminal 6. This is because, in the case of being subjected to a reflow or the like, the solder 8 is likely to go downward owing to self weight of the solder 8, and is less likely to go toward a side surface and upper surface of the lead wire 7. Hence, in the conventional magnetic component, a joint area of the solder 8 with the lead wire 7 and the external terminal 6 is small, and accordingly, connection strength therebetween is small. Meanwhile, in the magnetic component 1 according to this embodiment, in the case of using the soldering, as illustrated in FIG. 4(A), the solder 8 may be allowed to exist not only on the lower portion of the lead wire 3 but also on the side surfaces and upper surface thereof by the tip end surface 5B and projection portion 5C of the external terminal 5. Hence, the joint area of the lead wire 3 and the external terminal 5 may be signifimaytly increased in comparison with the conventional joint area, and the connection strength therebetween is increased. Further, in this embodiment of further using the soldering, it is easy to form large solder fillets between the tip end surfaces 4B and 5B and the projection portions 4C and 5C, and hence the connection strength by the soldering may be further enhanced.

(Other Embodiments)

The magnetic component according to this embodiment mentioned above is a suitable example of the present invention. However, the present invention is not limited thereto, and a variety of modifications are possible for the present invention as follows within the scope without changing the gist thereof.

In the above-mentioned embodiment, the magnetic component 1 is for use in the surface mounting. However, the magnetic component 1 is not particularly limited to the use in the surface mounting. Note that, in the case where the magnetic component 1 is for the use in the surface mounting, it is preferable that each of the external terminals include: a mounting board connecting portion; a plate-like protruding portion that hangs out of an outer circumference of the core and has a plate surface substantially parallel to a plane substantially orthogonal to the axial direction of the core; and a terminal end fixing portion provided so as to be erected from this protruding portion at a predetermined angle and to form a projection portion. Here, when the mounting board connecting portion is described while taking as an example the external terminal 5 illustrated in FIG. 1 and FIG. 2, the mounting board connecting portion corresponds to a portion of the external terminal 5, which is located on an inner circumferential side of the core 2. Further, the protruding portion having the terminal end fixing portion may be provided only on one side of the mounting board connecting portion illustrated in FIG. 1, FIG. 2 and the like. Alternatively, the protruding portion may be provided on both end portions thereof. In the case where the protruding portions having the terminal end fixing portions are provided on the both end portions of the mounting board connecting portion, both terminal ends of the lead wire wound around the spool portion may be protruded in directions substantially opposite to each other, and further, it is also possible to wind two coils.

In the above-mentioned embodiment, the core 2 is formed of the magnetic material such as the Mn—Zn based ferrite and the Ni—Zn based ferrite.

In the above-mentioned embodiment, the lead wire 3 is a conductor in which the cross section is circular. Alternatively, a conductor in which a cross section is rectangular, such as a belt-like conductor, may be used. Further, the lead wire 3 is wound a large number of times in the state of the so-called α-winding. Alternatively, the lead wire 3 is not limited to the α-winding, and other winding methods such as a usual spiral-like winding method may be adopted. However, in the case of using the lead wire 3 in which the cross section is rectangular, and differentiating the winding directions of the tip end portions 3A and 3B of the lead wire 3 from each other as illustrated in FIG. 1(A), the α-winding is easy, and hence it is preferable to adopt the α-winding.

Further, in the above-mentioned embodiment, the winding directions of the portions of both ends (tip end portions 3A and 3B) of the lead wire 3 are differentiated from each other. Alternatively, the winding directions of both ends of the lead wire 3 may be made the same direction (for example, such as a winding direction where both of the tip end portions 3A and 3B go clockwise). In this case, it is preferable that the arrangement position of one projection portion 4C or 5C be differentiated from that of the above-mentioned embodiment and the projection portions 4C and 5C be arranged on an end portion of the tip end surfaces 4B and 5B on an opposite side in a width direction so that the tip end portions 3A and 3B may be brought into contact with both of the tip end surfaces 4B and 5B and the projection portions 4C and 5C. This is because, in such a way, the tip end portions 3A and 3B are stably arranged when the tip end portions 3A and 3B are brought into contact with both of the tip end surface 4B and the projection portion 4C or both of the tip end surface 5B and the projection portion 5C.

In the above-mentioned embodiment, the projection portions 4C and 5C are provided on the end portions on the opposite side to the end portions to which the tip end surface 4B and the tip end surface 5B face. Alternatively, the projection portions 4C and 5C may be arranged on end portions to which the tip end surface 4B and the tip end surface 5B face. In such a configuration, it is preferable to invert the external terminals 4 and 5 on which the tip end portion 3A and the tip end portion 3B are arranged from each other. The reason for this is because the tip end portion 3A is brought into contact with the tip end surface 5B and the projection portion 5C and turns to a stable state, and the tip end portion 3B is brought into contact with the tip end surface 4B and the projection portion 4C and turns to a stable state.

In the above-mentioned embodiment, the tops of the projection portions 4C and 5C are located at the positions higher than the tops of the tip end portions 3A and 3B. Alternatively, the tops of the projection portions 4C and 5C may be located at positions lower than the tops of the tip end portions 3A and 3B or at the same positions as those of the tops of the tip end portions 3A and 3B. However, in order to stabilize the electrical connection between the lead wire 3 and the external terminals 4 and 5, it is preferable to locate the tops of the projection portions 4C and 5C at the positions higher than the tops of the tip end portions 3A and 3B as in the above-mentioned embodiment. For example, it is desirable that the height of the tops of the projection portions 4C and 5C is 1.5 times or more a diameter of the lead wire 3.

In the above-mentioned embodiment, the tip end portions 3A and 3B of the lead wire 3 protrude from the core 2 in substantially parallel to each other, that is, in the same direction. However, the protruding directions of the tip end portions 3A and 3B are not limited to such a protruding direction, and for example, the tip end portions 3A and 3B may be protruded in directions different from each other by 180°. However, it is preferable that the tip end portions 3A and 3B and the protruding portions 4A and 5A be protruded in the same direction with respect to the core 2. In this case, in the case of fixing the tip end portions 3A and 3B to the external terminals 4 and 5 by using the soldering, two connection portions (connection portion between the tip end portion 3A and the external terminal 4, and connection portion between the tip end portion 3B and the external terminal 5) may be simultaneously brought into contact with the molten solder in the same soldering pot. Further, in the above-mentioned embodiment, the lead wire 3 wound a large number of times around the circumferential surface of the core 2 is fixed by the adhesive, but the adhesive concerned is not an essential constituent, and hence the adhesive may be omitted.

Figure 5:
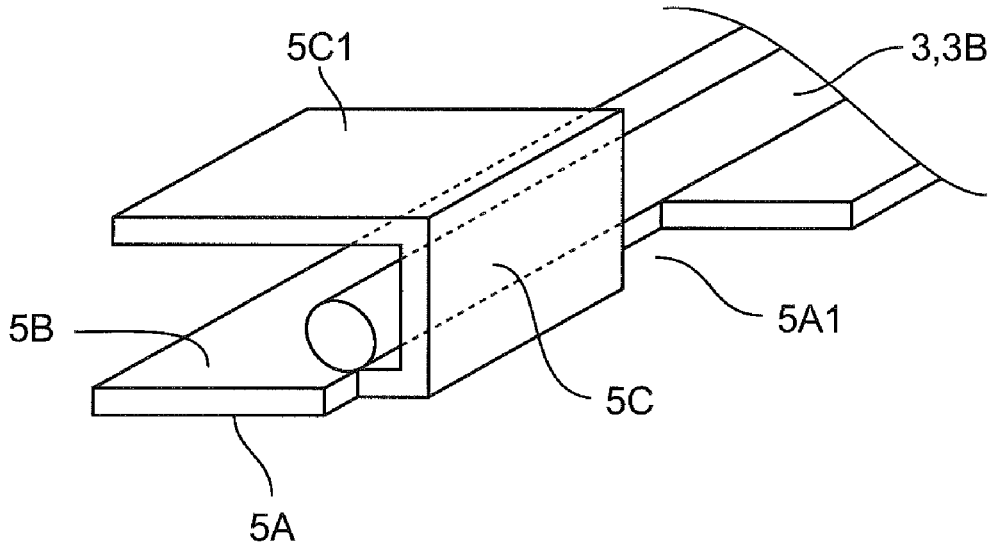
FIG. 5 is a view illustrating another example of the state where the tip end portion of the lead wire is mounted on the tip end surface of the protruding portion in which the notched portion and the projection portion (terminal end fixing portion) are formed.

In the above-mentioned embodiment, the projection portions 4C and 5C are formed by bending the one-side ends of the tip end surfaces 4B and 5B so that the one-side ends may be extended substantially perpendicularly in the direction of the upper collar portion 2A. However, for example, the projection portions may be those protruding from center portions of the tip end surfaces 4B and 5B, those formed by bending the tip end surfaces 4B and 5B so that the center portions thereof may be upheaved, or the like. Further, the projection portions may not be those extended substantially perpendicularly from the tip end surfaces 4B and 5B in the direction of the upper collar portion 2A, but for example, may be those bent in the direction of wrapping the lead wire 3. FIG. 5 is a view of a modification example of the form illustrated in FIG. 3, illustrating another example of the state where the tip end portion of the lead wire 3 is mounted on the tip end surface of the protruding portion in which the notched portion and the projection portion are formed. Note that, in FIG. 5, the same reference symbols are assigned to members having the same functions/configurations as those of FIG. 3. In the form illustrated in FIG. 5, a tip end portion 5C1 of the projection portion 5C is bent to the protruding portion 5A side in the form illustrated in FIG. 3. In this case, the tip end portion 5C1 may be bent to the protruding portion 5A side so as to be parallel to the tip end surface 5B as illustrated in FIG. 5. In the form illustrated in FIG. 5, the terminal end of the lead wire 3 is prevented from moving not only in the unwinding direction (right side direction in FIG. 5) but also in a vertical direction in FIG. 5. Therefore, the electrical connection between the lead wire 3 and the external terminals 4 and 5 may be extremely stabilized. Note that, the notched portions 4A1 and 5A1 are not essential constituents of the magnetic component 1, and hence the notched portions 4A1 and 5A1 concerned may be omitted.

In the above-mentioned embodiment, in the case of performing the soldering, the soldering of the tip end portion 3A and the projection portion 4C and the soldering of the tip end portion 3B and the projection portion 5C are performed simultaneously. However, the soldering of the tip end portion 3A and the projection portion 4C and the soldering of the tip end portion 3B and the projection portion 5C may be performed in different periods.

In the above-mentioned embodiment, in the event of manufacturing the magnetic component 1, a process of cutting the drawn-out portions (tip end portions 3A and 3B) of the lead wire 3 is not provided after the tip end portions 3A and 3B are positioned so as not to move in the expanding direction (unwinding direction). However, the tip end portions 3A and 3B may be prepared to be long in advance, and may be cut to a necessary length after such positional alignment as described above. Further, such cutting may be performed after the soldering (or welding) of the tip end portion 3A and the projection portion 4C and the soldering (or welding) of the tip end portion 3B and the projection portion 5C, which are thereafter performed according to needs.

Note that, though an angle formed by the protruding portion 5A and the terminal end fixing portion provided so as to form the projection portion 5C may be approximately 90° as illustrated in FIG. 3, it is preferable to set the angle concerned at an angle (acute angle) smaller than 90°. To be more specific, it is more preferable that the angle concerned ranges from 30° to 80°, and it is particularly preferable that the angle concerned ranges from 60° to 70°. The angle is set at 80° or less, whereby slippage on the contact portion between the tip end portion 3B of the lead wire 3 and the terminal end fixing portion becomes less likely to occur even if the force to move the tip end portion 3B of the lead wire 3 in the unwinding direction acts thereon. In particular, in the case where the unwinding direction is not perpendicular to a winding axis, the movement of the tip end portion 3B of the lead wire 3 may be received by the projection portion 5C that functions as the terminal end fixing portion and the tip end surface 5B by the fact that the above-mentioned angle is acute. Therefore, the electrical connection between the lead wire 3 and the external terminal 4 may be more stabilized. Further, the angle is set at 70° or less, whereby the force to move the tip end portion 3B of the lead wire 3 in the unwinding direction may be received by the terminal end fixing portion more surely. Accordingly, the tip end portion 3B of the lead wire 3 is fixed by the external terminal 5 more surely. Therefore, the electrical connection between the lead wire 3 and the external terminal 5 may be further stabilized. Note that a lower limit value of the angle is preferably 30° or more, more preferably 60° or more. The reason for this is to suppress a size increase of the protruding portion 5A in the width direction, which may be caused by the fact that the tip end portion 3B is arranged between the protruding portion 5A and the terminal end fixing portion.

Figure 6:
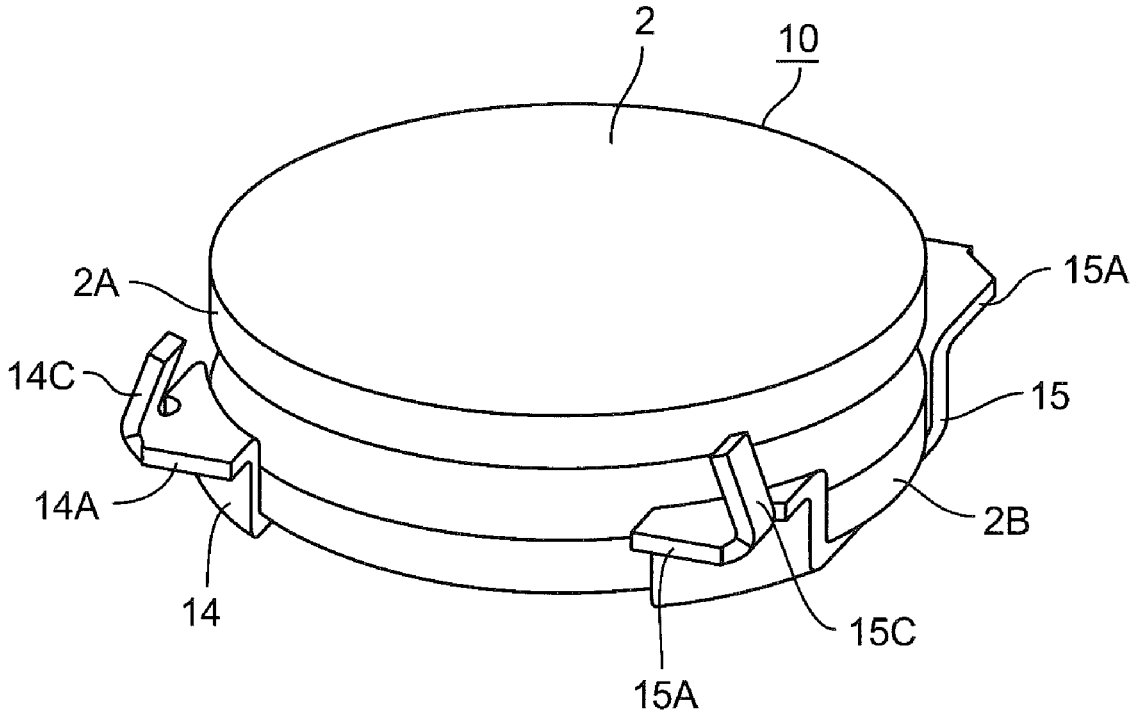
FIG. 6 is a perspective view illustrating a flat surface (surface opposite with a side facing to the mounting board) of a magnetic component according to another embodiment of the present invention, a front surface (surface on a side on which the tip ends of the lead wire protrude) thereof, and a right side surface thereof.

An example of a magnetic component including the external terminal as described above, in which the angle formed by the protruding portion 5A and the terminal end fixing portion provided so as to form the projection portion 5C approximately ranges from 60° to 70°, is illustrated in FIG. 6. FIG. 6 is a perspective view illustrating a flat surface (surface opposite with the side facing to the mounting board) of the magnetic component according to another embodiment of the present invention, a front surface (surface on the side on which the tip ends of the lead wire protrude) thereof, and a right side surface thereof. In FIG. 6, the same reference symbols are assigned to members having similar functions/configurations to those of FIG. 1. Further, in FIG. 6, illustration of the lead wire 3 is omitted. A magnetic component 10 illustrated in FIG. 6 has a similar configuration to that of the magnetic component 1 except that the external terminals 4 and 5 of the magnetic component 1 illustrated in FIG. 1 are replaced by external terminals 14 and 15. Such an external terminal 14 (15) has a similar configuration to that of the external terminal 4 (5) in that protruding portions 14A (15A) are provided on, both ends thereof, and that a projection portion 14C (15C) is provided on the protruding portion 14A (15A) on the front side in FIG. 6. However, the external terminal 14 (15) is different from the external terminal 4 (5) in that the angle formed by the protruding portion 14A (15A) and the terminal end fixing portion provided so as to form the projection portion 14C (15C) is not 90° as illustrated in FIG. 1 and the like but is an angle as acute as approximately ranging from 60° to 70°.

Figure 7:
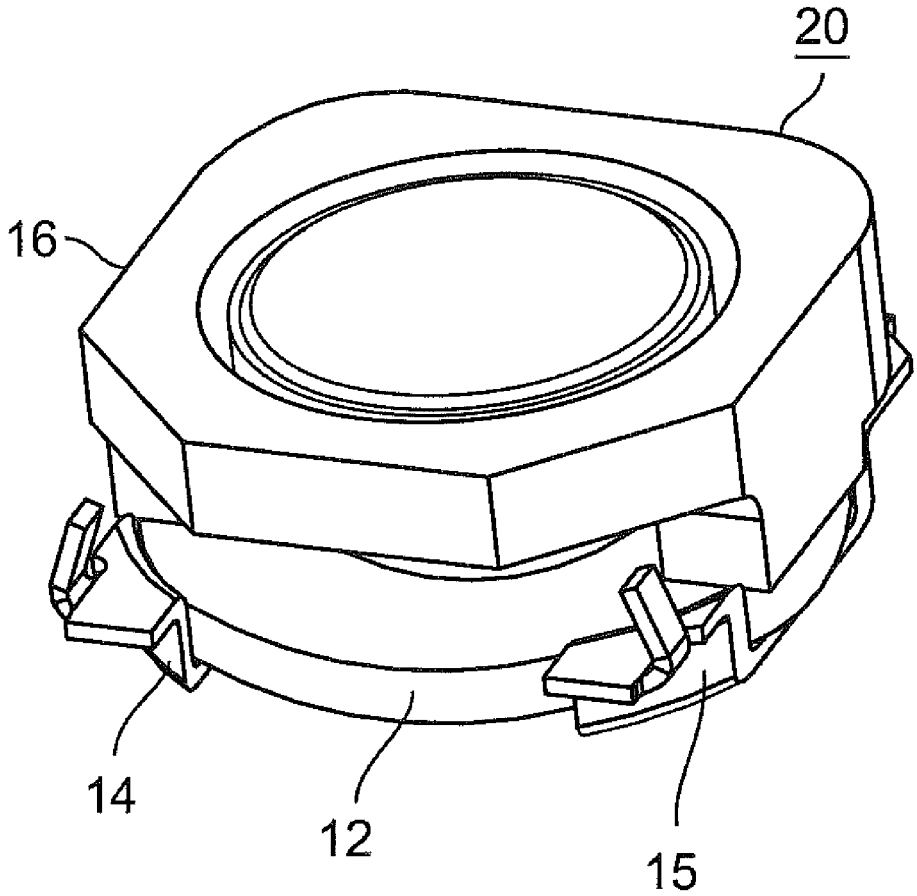
FIG. 7 is a perspective view illustrating a flat surface (surface opposite with a side facing to the mounting board) of a magnetic component according to still another embodiment of the present invention, a front surface (surface on a side on which the tip ends of the lead wire protrude) thereof, and a right side surface thereof.
Figure 8A:
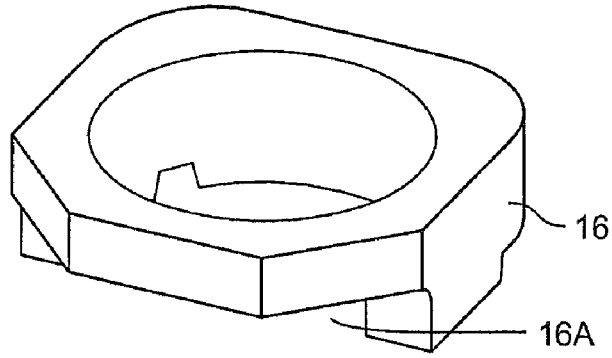
FIGS. 8(A), 8(B), and 8 (C) are perspective views illustrating the flat surface (surface opposite with the side facing to the mounting board), the front surface (surface on the side on which the tip ends of the lead wire protrude) thereof, and the right side surface thereof, in a state where the magnetic component 20 illustrated in FIG. 7 is disassembled into a ring core 16, a drum core 12, and external terminals 14 and 15.
Figure 8B:
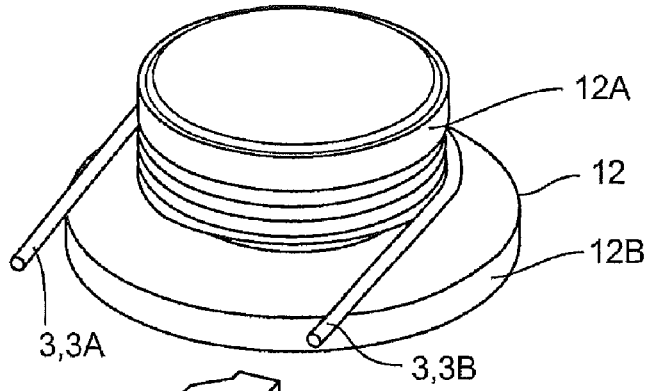
Figure 8C:
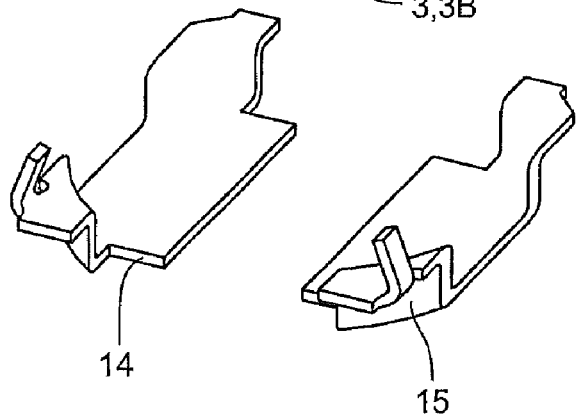

As the core, besides the modes illustrated in FIGS. 1 and 6, for example, a mode in which a drum core 12 and a ring core 16 arranged on an outer circumference of the drum core 12 are combined with each other as illustrated in FIG. 7 and FIG. 8, and the like may also be adopted. A magnetic component 20 illustrated in FIG. 7 includes the drum core 12, and the ring core 16 arranged on an outer circumference of an upper collar portion 12A of the drum core 12. Moreover, onto a lower collar portion 12B side of the drum core 12, the external terminals 19 and 15 similar to those for use in the magnetic component 10 illustrated in FIG. 6 are attached. Here, FIG. 7 is a perspective view illustrating the entire exterior appearance of the magnetic component 20, and FIG. 8 is a perspective view illustrating a state where the magnetic component 20 illustrated in FIG. 7 is disassembled. Note that, in FIG. 7 and FIG. 8, the same reference symbols are assigned to members having the same functions/configurations as those illustrated in FIG. 1 and FIG. 6. Further, in FIG. 7, the illustration of the lead wire 3 is omitted. The magnetic component 20 illustrated in FIG. 7 and FIG. 8 has a similar configuration to that of the magnetic component 10 illustrated in FIG. 6 except that a diameter of the disc-like upper collar portion 12A is smaller than a diameter of the lower collar portion 12B, and that the ring core 16 having a circular ring hole with a diameter a little larger than the diameter of the upper collar portion 12A is arranged on the outer circumference of the upper collar portion 12A. In the magnetic component 20, leakage of a magnetic flux generated from the lead wire 3 is suppressed, and an AL value (inductance value per unit number of turns of the lead wire 3) may be enhanced.

A height of this ring core 16 is substantially the same as a height from a surface of the lower collar portion 12B on a side on which the upper collar portion 12A is provided to a surface of the upper collar portion 12A on an opposite side with a side on which the lower collar portion 12B is provided. Further, a shape of the ring core 16 in plan view is substantially rectangular. Meanwhile, it is necessary that the tip end portions 3A and 3B of the lead wire 3 subjected to the α-winding along a spool portion of the drum core 12 be protruded from the drum core 12 in the same direction, and be connected to the external terminals 14 and 15. For this purpose, a lead wire drawing groove 16A is provided on a portion of the ring core 16 on a front surface (surface on a side on which the tip ends of the lead wire 3 protrude) side and on the lower collar portion 12B side. Note that the ring core 16 is formed of a magnetic material in a similar way to the drum core 12.

Further, the terminal end fixing portions are not limited to the form of being provided so as to be erected from the protruding portions partially composing the external terminals at the predetermined angle and to form the projection portions as illustrated in FIGS. 1, 2 and 6. For example, the terminal end fixing portions may be only provided so as to, directly couple to main body portions of the external terminals. As such a mode, for example, in the case where each of the external terminals includes the mounting board connecting portion and the (plate-like) protruding portion that hangs out of the outer circumference of the core, a portion obtained by twisting a tip end portion of the protruding portion so that a flat surface of the tip end portion concerned may become substantially parallel to the axial direction of the core may be utilized as the terminal end fixing portion.

Further, it is preferable that the terminal end fixing portion and the terminal end of the lead wire satisfy the following relationship in both of (1) the case where only the terminal end fixing portion is provided so as to directly couple to the main body portion of the external terminal as described above and (2) the case where the terminal end fixing portion is provided so as to be erected from the protruding portions partially composing the external terminal at the predetermined angle and to form the projection portion as illustrated in FIGS. 1, 2 and 6. Specifically, it is preferable that the height L1 of the terminal end fixing portion be larger than the height L2 of the cross section of the terminal end of the lead wire described above. In this case, even if the terminal end of the lead wire somewhat moves in the direction different from the unwinding direction, the connection between the terminal end of the lead wire and the external terminal may be maintained, and accordingly, the electrical connection between the lead wire and the external terminal may be stably maintained.

The invention claimed is:

1. A magnetic component, comprising:

a core comprising at least one collar and a spool portion around which a lead wire is wound; and external terminals to which both ends of the lead wire are connected, wherein the external terminals respectively comprise:

a mounting board connecting portion provided on a surface opposite to a surface of one collar selected from the at least one collar on a side on which the lead wire is present;

a plate-like protruding portion that is provided on at least one side of the mounting board connecting portion and is bent so as to wrap the core from the mounting board connecting portion side, the plate-like protruding portion hanging out of an outer circumference of the core, in which a plate surface of the hanging-out portion is substantially parallel to a plane substantially orthogonal to an axial direction of the core; and a terminal end fixing portion that is provided so as to be erected from the protruding portion toward a direction opposite to the side on which the one collar is arranged with respect to the spool portion at a predetermined angle and to form a projection portion and receives movement of terminal ends of the lead wire in an unwinding direction, and wherein the terminal ends of the lead wire are positioned by the terminal end fixing portions, and are connected to the external terminals, and the surface of the one collar on the side on which the lead wire is present and a surface of the protruding portion on a side on which the lead wire is present form substantially the same plane.

2. A magnetic component according to claim 1, wherein a height L1 of each of the terminal end fixing portions is larger than a height L2 of a cross section of each of the terminal ends of the lead wire.

3. A magnetic component according to claim 1, wherein the both ends of the lead wire protrude from the core toward the same direction.

4. A magnetic component according to claim 1, wherein the terminal end fixing portion has a plate shape.

5. A magnetic component according to claim 4, wherein the angle formed by the protruding portion and the terminal end fixing portion ranges from 30° to 80°.

6. A magnetic component according to claim 4, wherein the angle formed by the protruding portion and the terminal end fixing portion ranges from 60° to 70°.

7. A magnetic component according to claim 4, wherein a tip end portion of the terminal end fixing portion is bent to a side of the protruding portion.

8. A magnetic component according to claim 4, wherein the protruding portion comprising the terminal end fixing portion is individually provided on each end portion of the mounting board connecting portion.

9. A magnetic component according to claim 4, wherein a height dimension from a joint of the terminal end fixing portion to a top thereof in each of the external terminals is set larger than a height dimension of the both ends of the lead wire.

10. A magnetic component according to claim 1, wherein the core comprises a drum core, and further, a ring core is arranged on an outer circumference of the drum core.

11. A magnetic component according to claim 1, wherein the terminal ends of the lead wire and the external terminals are connected to each other by any one of connection methods selected from soldering and welding.

12. A magnetic component according to claim 1, wherein a surface of each of the terminal end fixing portions is provided at a position perpendicular with respect to the unwinding direction.

* * * * *